US009663277B2

(12) United States Patent
McGeough et al.

(10) Patent No.: US 9,663,277 B2
(45) Date of Patent: May 30, 2017

(54) CONTAINER CLOSURE

(71) Applicant: AptarGroup, Inc., Crystal Lake, IL (US)

(72) Inventors: Peter Michael McGeough, Crystal Lake, IL (US); Andrew Bell, Crystal Lake, IL (US)

(73) Assignee: AptarGroup, Inc., Crystal Lake, IL (US)

( * ) Notice: Subject to any disclaimer, the term of this patent is extended or adjusted under 35 U.S.C. 154(b) by 21 days.

(21) Appl. No.: 14/864,148

(22) Filed: Sep. 24, 2015

(65) Prior Publication Data

US 2017/0088321 A1 Mar. 30, 2017

(51) Int. Cl.

| | |
|---|---|
| ***B65D 47/00*** | (2006.01) |
| ***B67D 3/00*** | (2006.01) |
| ***B65D 53/06*** | (2006.01) |
| ***B65B 51/22*** | (2006.01) |
| ***B65D 47/12*** | (2006.01) |

(52) U.S. Cl.

CPC ..... *B65D 53/06* (2013.01); *B65B 51/227* (2013.01); *B65D 47/12* (2013.01)

(58) Field of Classification Search

CPC ..... B65D 53/06; B65D 47/12; B65D 2371/00148; B65D 53/00; B65D 51/18; B65D 2251/0003; B65D 2251/0006; B65B 51/227; Y10S 277/906; Y10S 425/809

USPC ..... 222/556, 153.03, 153.09; 277/650, 631, 277/628; 220/255, 254.1; 215/235

See application file for complete search history.

(56) References Cited

U.S. PATENT DOCUMENTS

| | | | | |
|---|---|---|---|---|
| 4,682,702 | A * | 7/1987 | Gach | B65D 47/103 215/235 |
| 4,993,606 | A * | 2/1991 | Bolen, Jr. | B65D 47/0885 215/235 |
| 6,866,164 | B2 * | 3/2005 | Branson | B65D 47/0814 222/153.14 |
| 7,048,158 | B2 * | 5/2006 | Hierzer | B65D 47/0814 215/235 |

(Continued)

FOREIGN PATENT DOCUMENTS

| | | |
|---|---|---|
| ES | 2339597 | 5/2010 |
| WO | 99/61337 A2 | 12/1999 |

(Continued)

OTHER PUBLICATIONS

PCT International Search Report and Written Opinion of International Searching Authority for International Patent Application No. PCT/US2016/052885, mailed Nov. 30, 2016, 12 pages.

*Primary Examiner* — J. Casimer Jacyna
*Assistant Examiner* — Benjamin R Shaw
(74) *Attorney, Agent, or Firm* — K&L Gates LLP

(57) ABSTRACT

A closure comprising a spout and a lid is secured to a wide mouthed container body, particularly a low tolerance HDPE container, by means of a plurality of double sided foil strips that are punched and welded to the base preferably in orientations parallel to one another on opposite sides of the opening and/or at right angles to each other. The strips are secondarily welded to the container to form a childproof, tamper-evident connection superior to mechanical latches and uses less material than a full or donut foil.

10 Claims, 2 Drawing Sheets

(56) References Cited

U.S. PATENT DOCUMENTS

| | | | | |
|---|---|---|---|---|
| 7,823,736 | B1 * | 11/2010 | Pugne | B65D 47/0838<br>215/232 |
| 8,827,094 | B2 | 9/2014 | McGeough et al. | |
| 2004/0094551 | A1 * | 5/2004 | Mavin | B29C 65/5057<br>220/258.2 |

FOREIGN PATENT DOCUMENTS

| | | | |
|---|---|---|---|
| WO | 2006/010960 | A1 | 2/2006 |
| WO | 2008062224 | | 5/2008 |
| WO | 2011/067585 | A1 | 6/2011 |

* cited by examiner

CONTAINER CLOSURE

TECHNICAL FIELD

The present invention relates to container closures and, more specifically, closures of the type which comprise a base member or spout secured to the container and a lid or cover that enables the closure to be reclosed or possibly resealed. More specifically, the present invention relates to closures of this type which are childproof and/or tamper evident closures.

BACKGROUND

A tamper evident container closure can be applied to a container body but cannot be removed without leaving evidence that the package has been tampered with.

Re-closable packages are used for a variety of goods that are stored in the home and to which it is undesirable for children to have access. These can include risky items such as pharmaceuticals or cleaning products or high-value products such as baby milk powder. Typically childproof containers use mechanical means which require greater intelligence or dexterity to operate. These can also confound the intended users. Moreover, a child attempting to open a re-closable package will not necessarily attack the lid but may simply try to prise the whole closure from the container, bypassing sophisticated childproof locking mechanisms.

Those with malicious intent may wish to contaminate the contents of a filled and un-opened container. Counterfeiting by the refilling of genuine containers also represents a serious risk to consumers and brand owners. While it is desirable that closures should be readily applied to the container body during the manufacturing process and also be separable for recycling and waste disposal purposes, the prevention of counterfeiting and contamination requires either that the separation be evident or result in such destruction of the closure and/or container body that it cannot be re-used.

The present invention particularly relates to large containers such as used for baby milk powder as described in WO 2011/067585 A (BAPCO CLOSURES RESEARCH LTD) Sep. 6, 2011. This type of container uses a closure having a spout that fits to a container body and defines an opening and a lid which closes over the spout. The amount of foil required to seal across the whole opening is necessarily large and adds considerably to the expense of such closures.

The use of the BAP (Registered Trademark) technology as described in WO 99/61337 A (SPRECKELSEN MCGEOUGH LTD) Feb. 12, 1999 whereby an induction heat sealed foil is bonded to both the container body and the closure and is removable by tearing out rather than peeling away, provides some intrinsic tamper evidence.

Existing BAP (Registered Trademark) closures typically use either a full foil across the whole of a mouth of the container or an annular (donut) foil in a slot around the periphery of the spout such as described in WO 2006/010960 A (BAPCO CLOSURES RESEARCH LTD) Feb. 2, 2006. For dry goods and where sealing is not imperative, but the cost of the closure is, the cost of the material required for a full foil or even a donut foil is a significant factor. Usually, when a donut foil is used, a central part which is punched out to form the required shape, goes to waste. The need to reduce materials represents a technical problem.

Existing designs of childproof and tamper evident closures often require high tolerance to enable the parts to fit together properly. This makes them more expensive and requires the use of plastics materials which are capable of being moulded with greater precision. Low-cost blow moulded HDPE containers are therefore difficult to provide with childproof and tamper evident closures.

The present invention addresses the technical problems of providing a low-cost childproof and tamper evident closure that can also be used on containers manufactured to a low tolerance.

SUMMARY OF INVENTION

The present invention provides a closure comprising a spout defining an opening, the spout having an underside adapted to be secured to a mouth of a container body, and a plurality of foil pieces secured to the underside, each of the foil pieces having an exposed face coated with a plastics material compatible with the material of the container body to enable the closure to be induction heat sealed to the container body.

Preferably the foil pieces are elongate strips. The strips may be positioned on the underside of the spout parallel to one another and/or in orientations inclined relative to each other. In a rectangular container the strips can be at right angles to each other. In an oval, circular or other shape, the strips will preferably be in opposed pairs distributed around the underside and at least some are inclined relative to one another.

The foil pieces are preferably made of double sided induction heat sealing foil so that they can be can be secondarily welded to the container to form a childproof, tamper-evident connection superior to mechanical latches. This type of connection uses much less material than a full foil.

The present invention also provides a method of sealing a closure to a plastics or plastic coated flange at a rim of a container, comprising the steps of positioning a closure having plastics coated conducting foil pieces embedded in a base of the closure which is adapted to rest on the flange, and using an induction weld head to weld the closure to the container to provide a permanent connection.

BRIEF DESCRIPTION OF THE DRAWINGS

In order that the invention may be well understood, an embodiment thereof will now be described, by way of example only, with reference to the accompanying diagrammatic drawings, in which.

DETAILED DESCRIPTION OF THE INVENTION

Figure 1:
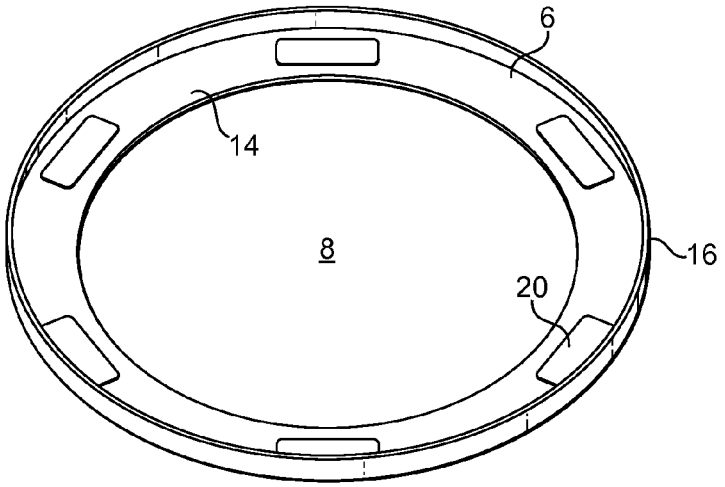
FIG. 1 is a view of an interior of a base of a spout of a first embodiment of the closure.

The closure 2 is intended to be fitted to an open top or mouth of a container body 4. The container may be a low tolerance plastics containers such as a blow moulded HDPE jar, bottle or tub. Closures of this type can also be used with other containers made of or having a rim coated with plastic. The container has a flat flange or rim 5 surrounding its mouth on which a closure 2 can be seated in position. If the container is not made of a plastics material the flange can be coated with a suitable plastics material to enable it to be welded to the closure.

The closure comprises a base member or, to use the normal terminology for BAP closures, a spout 6 defining an opening 8. The spout has a base surface which is shaped to overlie a corresponding opening in the container 4. In some configurations the spout may be no more than a laminar base member. In other configurations, it may have additional features as dictated by the function it is to perform. The spout is intended to become permanently connected to the container until separation is necessary for recycling. A lid 10 is provided to close the opening 8. This may be hinged to the spout 6. The spout or base member is shown as having a frame structure which rests on the rim of the container and is defined by a flat surface 14 corresponding to the rim of the container. A depending skirt 16 may be provided around the outer edge of the frame in order to facilitate location of the closure on the container prior to the securing step.

The closure 6 will typically be an injection moulded or thermoformed plastics item, but may be made of other materials provided that an underside of the closure is coated with a suitable plastics material to which foil pieces can be secured.

Figure 2:
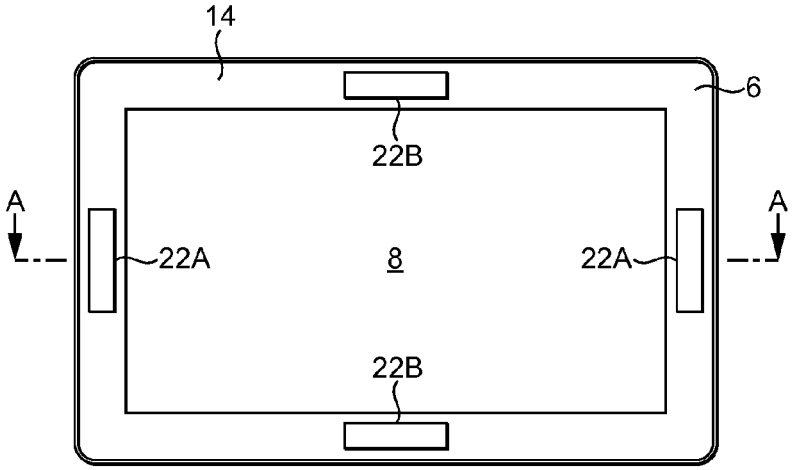
FIG. 2 is a view of an interior of a base of a spout of a second embodiment the closure.
Figure 3:
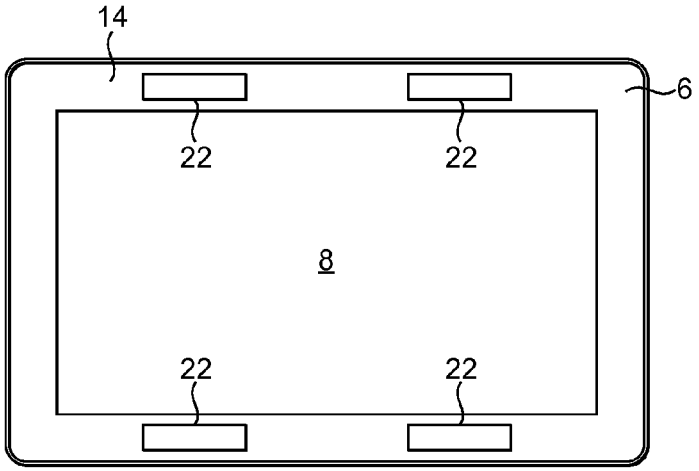
FIG. 3 is a view of an interior of a base of a spout showing a variation of the second embodiment the closure.
Figure 4:
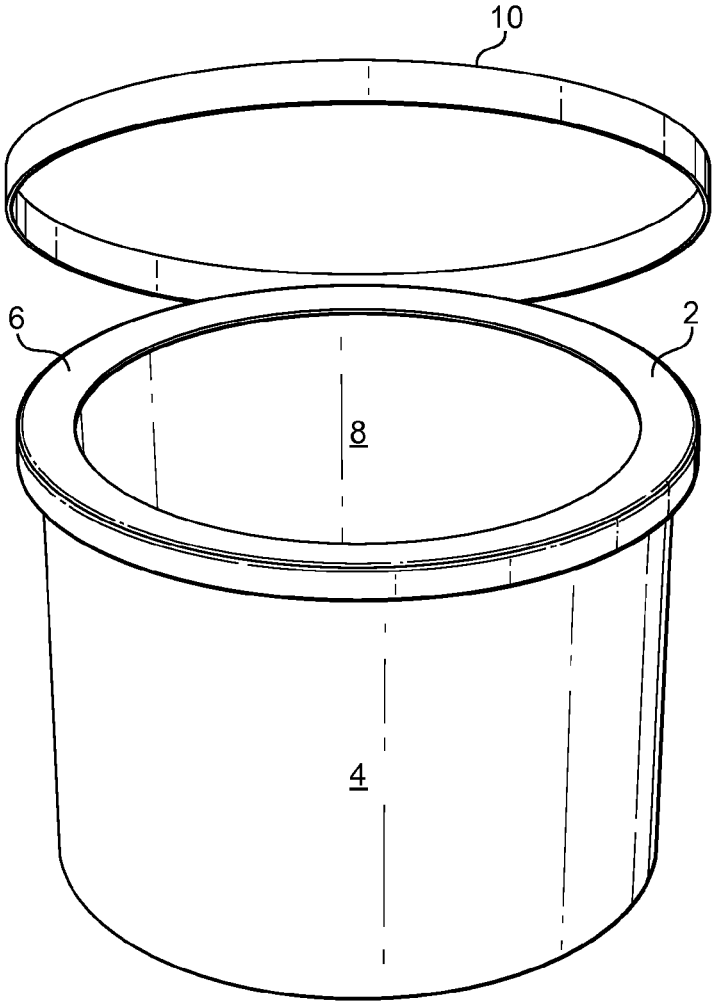
FIG. 4 is a perspective view of a container body with the first embodiment of the closure fitted thereto.
Figure 5:
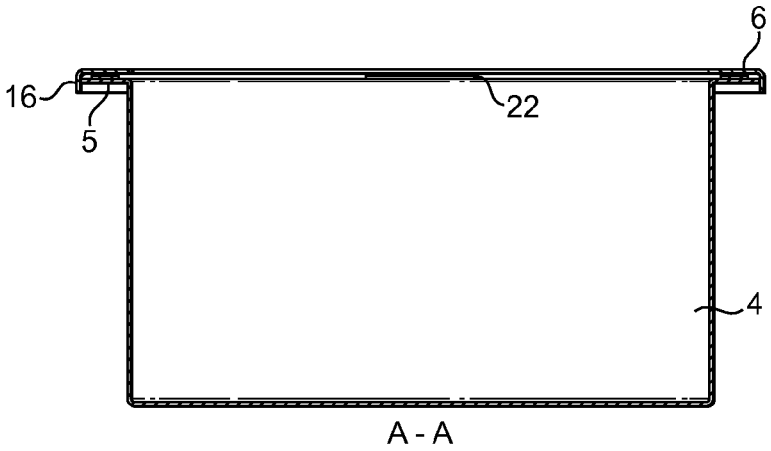
FIG. 5 is a longitudinal cross section through a sealed container and closure of FIG. 2 taken at A-A a position where there are foil pieces between the spout and a rim of the container.

Pieces or patches 20 of induction heat sealing foil are secured at spaced intervals around the surface 14 of the spout. The foil pieces are discrete and separate from one another. They do not have to be the same size or shape but must be sufficiently large to generate the required heating effect when placed in an induction field. The pieces of foil are preferably elongate strips 22 as shown in FIGS. 2 and 3. Strips of about 20 to 25 mm in length and 4-5 mm in width have been found to work satisfactorily. Rounded ends may assist the flow of the induced currents but more economically cut squared edges have also been found to be effective. The patches or strips must be long enough to allow an induction current to flow around the periphery to create the necessary heating effect.

The pieces can be punched and placed from a web and dropped into position on the surface 14. The pieces can be arranged in one or more pairs parallel to one another on opposite sides of the container opening. In FIG. 2 two pairs of strips 22A and 22B are shown. In order to place a pair of strips, the spouts can be arranged to travel beneath a web of foil having a width corresponding to the required length of the elongate strips. A punch can then be used to press out an elongate strip from the foil to place on one side of the opening of a spout travelling on a conveyor beneath the web. The foil web is indexed by a short distance relative to the fixed punch as the conveyor moves the spout along so that the opposite side of the opening is beneath the punch. The second strip of the pair can then be punched and placed. This sequence allows extremely efficient usage of the foil material. If required a second pair of elongate strips can be placed by moving the spouts at right angles to the original direction of travel beneath a second foil web and punch. It will be appreciated to the skilled man that other techniques for placing the foil in the spout are possible.

FIG. 3 shows a variation in which the foil strips 22 are only provided along the long sides of a rectangular closure. Such an arrangement even with one strip on each side would be sufficient for providing a tamper evident and anti-counterfeiting connection to the container.

If the foil is a double sided induction heat sealing foil, the foil strips 22 can be welded in position by passing the spout under a suitably designed induction weld head to create a primary weld between the foil pieces and the spout. Alternatively, the foil pieces could be overmoulded into position during the closure injection moulding process. In that case the positioning of the strips would be directly into the mould cavities rather than onto the surface 14 as described above. In another embodiment, the foil pieces could be reinforced with a foam layer and the flat surface 14 of the spout defined as the base of a slot that would retain the foil pieces in position until they are welded simultaneously to the spout and the container body.

The arrangement of foil pieces is a matter of design and is dictated by factors such as the size of the container, the rigidity of the connection required and the requirements for cooperation with the induction head. If only tamper evidence is required, fewer pieces, such as two strips on either side of a rectangular container could be provided. To make the connection resistant to breakage by a child pulling and twisting on the closure, arranging the foil strips so that they are in different orientations, preferably at right angles to one another, is desirable.

Double sided induction heat sealing foil pieces are punched from a conducting foil which has a coating of a compatible plastics material adhered to each surface of the foil so that it can be welded both to a rim of the container body and to the base of the closure. This material can be described as a foil liner.

Once the container has been filled with its intended contents, a closure complete with its foil pieces is positioned over the rim of the container body and the assembly passed under a weld head designed to create an induction field of the required shape to induce heat in the foil strips and cause them to be welded to the rim of the container body. This is the secondary weld if a primary welding step has already taken place during manufacture of the closures. The weld head is designed to be effective for the given foil strip geometry and location.

For recycling purposes, it is desirable for plastics and metals to be separable. By using only relatively small pieces of foil, the used container is more suitable for recycling.

The use of relatively modestly sized and shaped foil pieces, which can be cut from a foil with little wastage, means that the cost of the foil is a less significant part of the cost of the closure than in other designs using a full foil or donut foil solution.

Because a number of foil pieces or strips are provided and they can have a size chosen to ensure that there is an overlap between them and the rim, even in the case of significantly off-tolerance containers, this type of connection method is not dependent on the precise size relationship between the closure and container. This overcomes the problem of mechanical childproofing connections, which require close tolerances.

When a spout that has been induction welded to a container by the described method is removed, extreme force is required. The spout will be distorted and considerably damaged by the removal at least in the positions of the foil pieces. This ensures that tamper evidence is provided as the closure cannot be removed without considerable damage and therefore could not be replaced.

This type of closure is suitable for requirements where neither a full barrier nor a 100% liquid tight seal is required. However, it can be employed with closures where an airtight seal is provided by other mechanical means known to those skilled in the art.

The invention claimed is:

1. A closure comprising:

a base defining an opening, the base having an underside adapted to be secured to a mouth of a container body, and a plurality of foil pieces secured to the underside, each of the foil pieces having an exposed face coated with a plastics material compatible with the material of the container body to enable the closure to be induction heat sealed to the container body.

2. A closure as claimed in claim 1, wherein the foil pieces are elongate strips.

3. A closure as claimed in claim 2, wherein the strips have rounded ends.

4. A closure as claimed in claim 2, wherein the strips have squared ends.

5. A closure as claimed in claim 2, wherein the elongate strips are positioned on the underside of the base parallel to one another on opposite sides of the opening.

6. A closure as claimed in claim 5, wherein there is only a single pair of strips.

7. A closure as claimed in claim 2, wherein the elongate strips are positioned on the underside of the base in orientations at right angles to each other.

8. A closure as claimed in claim 1, wherein the foil pieces are distributed around the underside and at least some are inclined relative to each other.

9. A closure as claimed in claim 1, further comprising a lid for closing the opening.

10. A closure comprising a base member defining an opening, the base member having an underside adapted to be secured to a mouth of a container body, and a plurality of foil pieces secured to the underside, each of the foil pieces having an exposed face coated with a plastics material compatible with the material of the container body to enable the closure to be induction heat sealed to the container body.

* * * * *